US005572826A

United States Patent [19]

Weder

[11] Patent Number: 5,572,826

[45] Date of Patent: Nov. 12, 1996

[54] COLLAPSIBLE VASE FOR CONTAINING A FLORAL GROUPING

[76] Inventor: Donald E. Weder, 1111 Sixth St., Highland, Ill. 62249

[21] Appl. No.: 242,524

[22] Filed: May 13, 1994

[51] Int. Cl.[6] ..... A01G 5/00

[52] U.S. Cl. ..... 47/41.12; 47/41.01; 383/11; 383/14; 383/120

[58] Field of Search ..... 383/11, 14, 18, 383/104, 120; 47/72, 39, 41.12, 41.01; 248/500, 510, 205.3

[56] References Cited

U.S. PATENT DOCUMENTS

| | | | |
|---|---|---|---|
| D. 335,105 | 4/1993 | Ottenwalder et al. . | |
| 524,219 | 8/1894 | Schmidt . | |
| 732,889 | 7/1903 | Paver . | |
| 950,785 | 3/1910 | Pene . | |
| 1,063,154 | 5/1913 | Bergen . | |
| 1,446,563 | 2/1923 | Hughes . | |
| 1,610,652 | 12/1926 | Bouchard . | |
| 1,697,751 | 1/1929 | Blake . | |
| 2,048,123 | 7/1936 | Howard . | |
| 2,170,147 | 8/1939 | Lane . | |
| 2,278,673 | 4/1942 | Savada . | |
| 2,302,259 | 11/1942 | Rothfuss . | |
| 2,510,120 | 6/1950 | Leander . | |
| 2,529,060 | 11/1950 | Trillich . | |
| 2,621,142 | 12/1952 | Wetherell . | |
| 2,648,487 | 8/1953 | Linda . | |
| 2,774,187 | 12/1956 | Smithers . | |
| 2,966,294 | 12/1960 | Pelfrey | 383/11 |
| 2,989,828 | 6/1961 | Warp . | |
| 3,022,605 | 2/1962 | Reynolds . | |
| 3,271,922 | 9/1966 | Wallerstein . | |
| 3,376,666 | 4/1968 | Leonard . | |
| 3,431,706 | 3/1969 | Stuck . | |
| 3,508,372 | 4/1970 | Wallerstein . | |
| 3,552,059 | 1/1971 | Moore . | |

(List continued on next page.)

FOREIGN PATENT DOCUMENTS

| | | |
|---|---|---|
| 2489126 | 3/1982 | France . |
| 2589436 | 5/1987 | France . |
| 513971 | 11/1930 | Germany . |
| 542958 | 2/1993 | Japan . |
| 560532 | 4/1975 | Switzerland . |

OTHER PUBLICATIONS

Exhibit A—Chantler & Chantler brochure showing Zipper Sleeve™ and Florasheet®, Date unknown, 2 pages.

Exhibit B—"Color Them Happy with Highlander Products"© 1992.

Exhibit C—"Super Seller", Supermarket Floral, Sep. 15, 1992.

Exhibit D—"Costa Keeps the Christmas Spirit", Supermarket Floral, Sep. 15, 1992.

Exhibit E—"Now More Than Ever", Supermarket Floral, Sep. 15, 1992.

Exhibit F—"Halloween", Link Magazine, Sep. 1992, 2 pages.

Exhibit G—Speed Cover Brochure, "The Simple Solution For Those Peak Volume Periods", Highland Supply Corporation, ©1989.

Exhibit H—"Speed Sheets and Speed Rolls" Brochure, Highland Supply Corporation, ©1990.

Exhibit I—"A World of Cut Flower and Pot Plant Packaging" Brochure, Klerk's Plastic Products Manufacturing, Inc., Date unknown, 6 pages.

*Primary Examiner*—Henry E. Raduazo

[57] ABSTRACT

A Collapsible container for holding a floral grouping in a vertical position. The container is constructed from a flexible material and comprises a body, an upper open end and a closed lower end. A bonding material is disposed upon a portion of the outer surface of the closed base for enabling the container to be bondingly connecting to a surface for supporting the floral grouping in a vertical position. The container is collapsible to a substantially flat position and expandable therefrom to an expanded form for receiving a portion of a floral grouping in the interior space. The container may have a sheet extension for providing a protective wrap about a portion of a floral grouping.

45 Claims, 2 Drawing Sheets

U.S. PATENT DOCUMENTS

| | | | |
|---|---|---|---|
| 3,556,389 | 1/1971 | Gregoire . | |
| 3,557,516 | 1/1971 | Brandt . | |
| 3,589,595 | 6/1971 | White | 383/11 |
| 3,793,799 | 2/1974 | Howe . | |
| 3,869,828 | 3/1975 | Matsumoto . | |
| 3,962,503 | 6/1976 | Crawford | 47/12 |
| 4,043,077 | 8/1977 | Stonehocker . | |
| 4,054,697 | 10/1977 | Reed et al. . | |
| 4,091,925 | 5/1978 | Griffo et al. . | |
| 4,118,890 | 10/1978 | Shore . | |
| 4,189,868 | 2/1980 | Tymchuck et al. . | |
| 4,280,314 | 7/1981 | Stuck . | |
| 4,333,267 | 6/1982 | Witte . | |
| 4,335,769 | 6/1982 | McManus | 383/11 |
| 4,400,910 | 8/1983 | Koudstaal . | |
| 4,413,725 | 11/1983 | Bruno et al. . | |
| 4,546,875 | 10/1985 | Zweber . | |
| 4,623,112 | 11/1986 | Olson | 248/205.3 |
| 4,640,079 | 2/1987 | Stuck . | |
| 4,765,464 | 8/1988 | Ristvedt . | |
| 4,773,182 | 9/1988 | Weder et al. . | |
| 4,801,014 | 1/1989 | Meadows . | |
| 4,835,834 | 6/1989 | Weder . | |
| 4,941,572 | 7/1990 | Harris . | |
| 4,980,209 | 12/1990 | Hill . | |
| 5,073,161 | 12/1991 | Weder et al. . | |
| 5,105,599 | 5/1992 | Weder . | |
| 5,111,638 | 6/1992 | Weder . | |
| 5,120,382 | 10/1992 | Weder . | |
| 5,152,100 | 10/1992 | Weder . | |
| 5,181,364 | 1/1993 | Weder . | |
| 5,199,242 | 4/1993 | Weder . | |
| 5,205,108 | 4/1993 | Weder et al. . | |
| 5,235,782 | 8/1993 | Landau . | |
| 5,259,106 | 11/1993 | Weder et al. . | |

COLLAPSIBLE VASE FOR CONTAINING A FLORAL GROUPING

BACKGROUND

The present invention relates to containers formed from sheets of material and more particularly to containers, such as vases, which are used to hold floral groupings.

DESCRIPTION OF THE INVENTION

Figure 1:
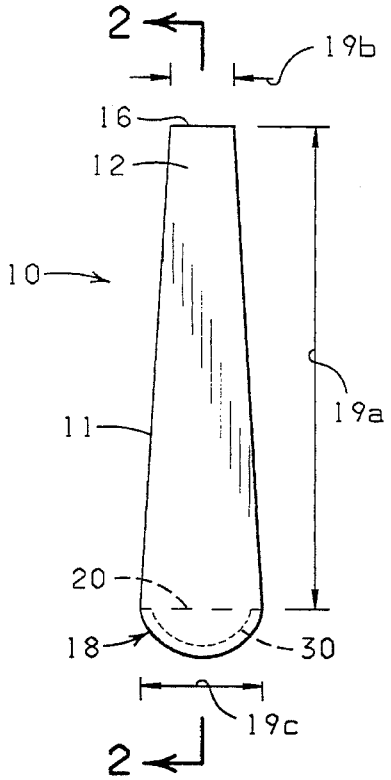
FIG. 1 is a plan view of a flattened vase constructed in accordance with the present invention.

Vases currently available are bulky. There exists a need for a decorative vase which is lightweight and collapsible and thus conserving of storage or shipping space, but which is able to support a floral grouping in a vertical orientation in the manner of a vase. The present invention satisfies such a need. In particular, the present invention comprises a collapsible container constructed from a flexible material for holding a floral grouping. The container comprises an upper end having an opening and a lower end having a closed base. The closed base has an outer surface and an inner surface. The container further comprises a tubular body 11 having an outer peripheral surface which extends from the upper end of the container to the outer surface of the closed base and an inner peripheral surface which encompasses and defines an interior space which extends from the opening to the inner surface of the closed base. The container also has a bonding material disposed upon a portion of the outer surface of the closed base for bondingly connecting to a surface. The container is collapsible to a substantially flat position and expandable therefrom to an expanded form for receiving a portion of a floral grouping in the interior space. The floral grouping is supported in a vertical position by the container when the bonding material on the closed base is bondingly connected to a surface, such as a transport surface or display table.

Preferably the container has the appearance and functionality of a vase when in expanded form. The container may have a gusset in the closed base for enhancing flatness of the container when in a collapsed position. The container may also have an area of bonding material on a portion of the outer peripheral surface of the body for enabling attachment of a label, card, note, or other information delivery means. The container may further comprise a label disposed on a portion of the outer peripheral surface. In one version of the invention, the container comprises a release strip which covers the bonding material prior to use of the bonding material to engage a surface. The flexible material used to form the container may be a paper (untreated or treated in any manner), cellophane, foil, polymer film, fabrics (woven or nonwoven, synthetic or natural), burlap, or a combination thereof. The container in one version may be a bud vase for containing one bud or flower. The bonding material disposed on the closed base may be an adhesive or cohesive or other bonding material which functions in accordance with the present invention. The container may further comprise a sheet extension attached to the upper end of the tubular body and which is extendable a distance beyond the upper end of the body for providing a protective wrap about a portion of a floral grouping. The invention may also comprise a plant package which comprises the container with a floral grouping disposed therein. Further, a floral holding material may be disposed within the interior space of the container for supporting a floral grouping in the container.

Figure 2:
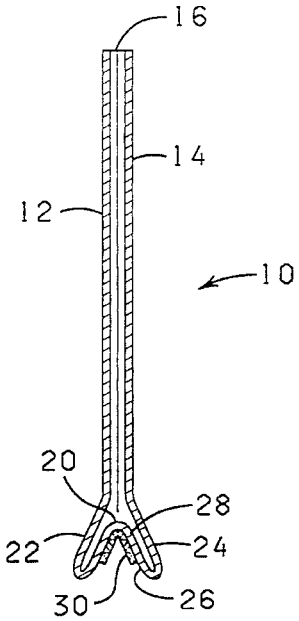
FIG. 2 is a side sectional view of the vase shown in FIG. 1.

Referring now to FIG. 1, a container fabricated in accordance with the present invention is designated by the general reference numeral 10. The container 10 is disposed in a collapsed or flattened condition. The container 10 has a first side 12, a second side 14, as indicated in FIG. 2, an upper end 16, a bottom end 18 and a bottom crease 20 shown in FIG. 2 and a first bottom fold 22 and a second bottom fold 24 also indicated in FIG. 2. The container 10 further comprises a height **19*a*, a bottom diameter 19*c*, as measured when the container is in the flattened position, and an upper diameter 19*b***, as measured when the container is in a flattened position. An example of a method of how to form such container is shown in U.S. Ser. No. 08/219,221 titled "Method and Apparatus for Forming Sleeves" filed on Mar. 28, 1994, and which is hereby incorporated by reference herein.

Figure 3:
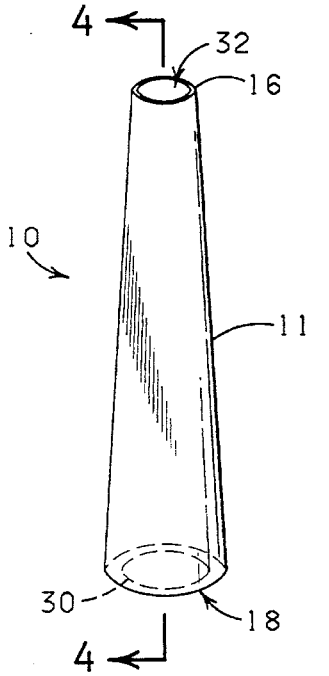
FIG. 3 is a perspective view of the vase of FIG. 1 in an opened configuration.
Figure 4:
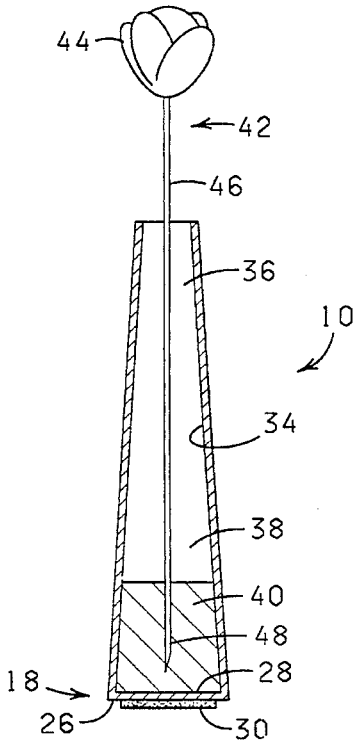
FIG. 4 is a side sectional view of the open vase of FIG. 3.

Shown in FIGS. 2–4 is an outer bottom surface 26 of the bottom end 18 of the container 10 and the inner bottom surface 28 of the bottom end 18 of the container 10. Disposed upon a portion of the bottom end 18 of the outer bottom surface 26 of the container 10 is a bonding material 30. The bonding material 30 enables an open container 10 to be bondingly adhered to a surface, thereby anchoring the container 10 so it will remain in an upright or vertical position. In operation, one of the flattened containers 10 is opened up by causing the first bottom fold 22 and second bottom fold 24 to be extended outward thereby causing the outer bottom surface 26 to be flattened, thereby opening the first side 12 and second side 14 into the form of a tube as shown in FIG. 3. The now open container 10 further comprises an upper end opening 32 near the upper end 16 of the container 10, an interior surface 34, an upper interior space 36 and a lower interior space 38 which is continuous with the upper interior space 36 (FIG. 4).

A floral holding material 40 may be disposed within the lower interior space 38 of the container 10 for stabilizing the floral grouping 42 which may be disposed within the container 10 (FIG. 4). The floral grouping 42 further comprises in the preferred embodiment a bloom end 44, a stem portion 46 and an end portion 48 which is disposed within the floral holding material 40 when the floral holding material 40 is present.

Figure 5:
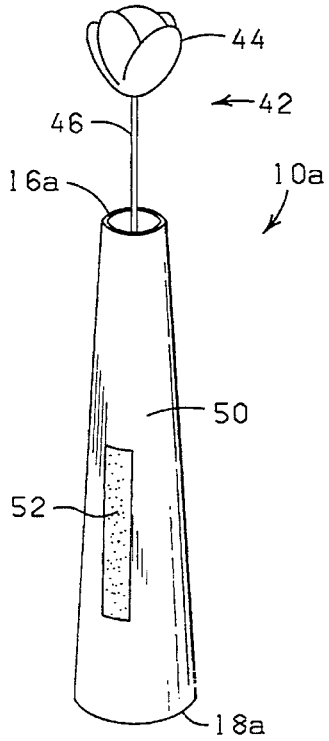
FIG. 5 is a perspective view of another vase constructed in accordance with the present invention.

FIG. 5 shows an alternate version of a container similar to the container 10 of FIGS. 1 through 4 which is designated by the general reference numeral **10*a*. The container 10*a* is almost exactly the same as the container 10 shown in FIGS. 1 through 4 having an upper end 16*a*, a bottom end 18*a*, a floral grouping 42 disposed therein (when in operation), and an outer surface 50. The feature of the container 10*a* which is different from the container 10 is the presence of a bonding material 52 on the outer surface 50 of the container 10*a* for allowing the bonding of notes, labels, cards or other information delivery means which may be disposed upon the container 10***a*.

Figure 6:
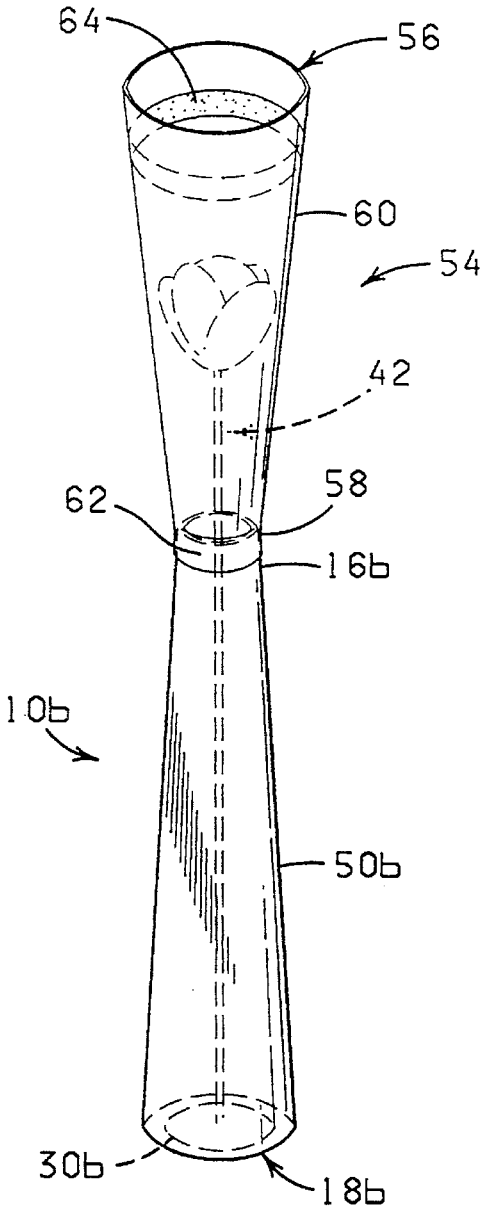
FIG. 6 is a perspective view of another vase constructed in accordance with the present invention, the vase having a sheet extension.
Figure 7:
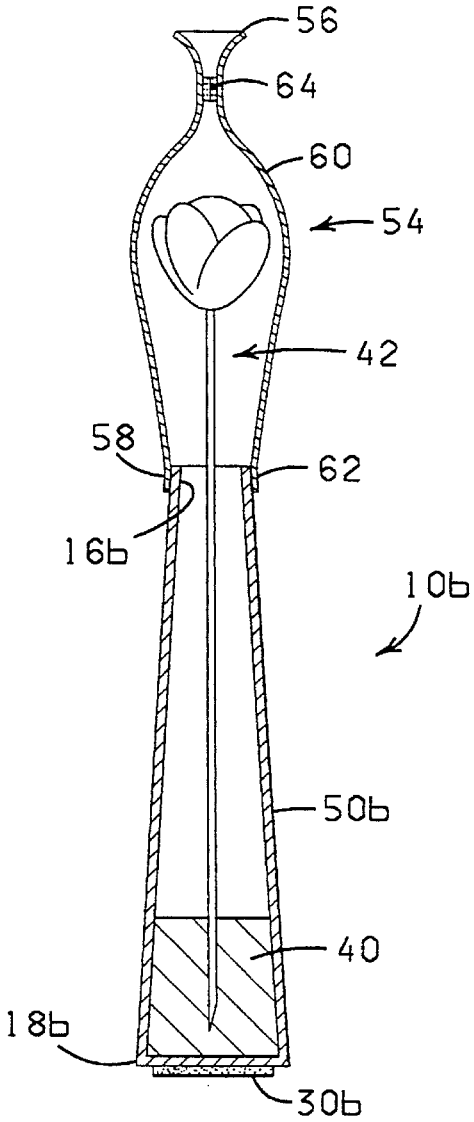
FIG. 7 is a side sectional view of a vase formed using the sheet of material as shown in FIG. 6.

Turning now to FIGS. 6 and 7, an alternate version of the present invention is shown. FIG. 6 shows a container designated by the general reference numeral 10*b* which has an upper end 16*b*, a lower end 18*b*, a bonding material 30*b* and an outer peripheral surface 50*b*. The container 10*b* is exactly the same as container 10 except for the presence of a sheet extension 54.

The sheet extension 54 is connected to an upper portion of the container 10*b*. The sheet extension 54 comprises an upper end 56, a lower end 58, an outer peripheral surface 60, and a closure bonding material 64 disposed near the upper end 56 of the sheet extension 54. The lower end 58 of the sheet extension 54 is attached to the upper end 16*b* of the container 10*b* forming a sealed or attached area 62. As is indicated in FIGS. 6 and 7, the upper end 56 of the sheet extension 54 may be crimped or otherwise sealed via the closure bonding material 64 above the floral grouping 42 for providing protective space for the floral grouping 42 during the shipment of the vase or container 10*b*.

The sealed or attached area 62 or another portion of the container 10*b* or sheet extension 54 may further comprise detaching means such as perforations or a tear strip (not shown) for allowing all or part of the sheet extension 54 to be removed from the container 10*b*. The sheet extension 54 may comprise ventilation holes for allowing gas exchange after the sheet extension has been sealed.

The flexible material used to construct the containers 10–10*b* or the sheet extension 54 may have a thickness in a range of from about 0.1 mils to about 30 mils. Preferably, the material of the container 10 has a thickness in a range from about 0.2 mils to about 10 mils. More preferably, the material of the container 10 has a thickness of from about 0.5 mils to about 5 mils.

The container 10 may be any shape and the frusto-conical shape is shown in FIG. 1 only by way of example. The container 10, may, for example, be rectangular, circular, triangular, trapezoidal, or any other geometric shape which functions in accordance with the purpose disclosed herein. It will be appreciated by one of ordinary skill in the art that the vase shapes displayed herein are but a small sample of the great variety of shapes of vases which may be formed to function in accordance with the present invention.

The container 10 may be constructed of a single layer of material or a plurality of layers of the same or different types of materials. Any thickness of the flexible material may be utilized in accordance with the present invention as long as the container 10 can function as a vase, or floral container, but in particular a bud vase, as described herein. The layers of material comprising the container 10 may be connected together or laminated or may be separate layers.

By "vase" is meant a vessel, substantially higher than it is wide, which is used to hold a floral grouping or other decoration. More particularly, the height of the vase is generally at least three to five times greater than the narrowest diameter. When used herein the term "bud vase" refers to a vase for holding just one to several cut flowers or buds.

The term "vase" refers to any type of container used for holding a floral grouping or single floral cuttings. "Floral grouping" as used herein means cut fresh flowers, artificial flowers, a single flower either fresh and/or artificial plants or other floral materials and may include other secondary plants and/or ornamentation or artificial or natural materials which add to the aesthetics of the overall floral arrangement. The floral grouping generally comprises a bloom or foliage portion and a stem portion. However, it will be appreciated that the floral grouping may consist of only a single bloom or only foliage (not shown). The term "floral grouping" may be used interchangeably herein with the term "floral arrangement".

The container 10 and the second flexible sheet of material (if used) may be constructed of a single layer of material or a plurality of layers of the same or different types of materials. Any thickness of the flexible material of container 10 may be utilized in accordance with the present invention as long as the flexible material may be formed into a vase for containing a floral grouping, in the manner described herein. Additionally, an insulating material such as bubble film, preferable as one of two or more layers, can be utilized in order to provide additional protection for the item contained in the vase.

In a preferred embodiment, the flexible material 10 is constructed from two polypropylene films laminated together (e.g. a polypropylene film such as Mobil 220 AB clear film laminated to a sheet of Mobil 270 ABW white opaque film). The container 10 is constructed from any suitable flexible material that is capable of being formed into a container or vase for containing a floral grouping. Preferably, the flexible material of container 10 comprises a paper (untreated or treated in any manner), cellophane, foil, polymer film, fabric (woven or nonwoven or synthetic or natural), burlap, or combinations thereof. The term "polymer film" means a man-made polymer such as a polypropylene or a naturally occurring polymer such as cellophane. A polymer film is relatively strong and not as subject to tearing (substantially non-tearable), as might be the case with paper or foil.

The flexible material of container 10 may vary in color. Further, the container 10 may consist of designs or decorative patterns which are printed, etched, and/or embossed thereon using inks or other printing materials. An example of an ink which may be applied to the surface of the container 10 is described in U.S. Pat. No. 5,147,706, entitled "Water Based Ink On Foil And/Or Synthetic Organic Polymer", issued to Kingman on Sep. 15, 1992 and which is hereby incorporated herein by reference. In addition, the container 10 may have various colorings, coatings, flocking and/or metallic finishes, or other decorative surface ornamentation applied separately or simultaneously or may be characterized totally or partially by pearlescent, translucent, transparent, iridescent or the like, qualities. Each of the above-named characteristics may occur alone or in combination and may be applied to the upper and/or lower surface of the flexible material of the container 10. Moreover, each surface of the flexible material of container 10 may vary in the combination of such characteristics. The flexible material of container 10 itself may be opaque, translucent or partially clear or tinted transparent.

The flexible material of container 10 may also be constructed in part from a cling material (for example, to form the sheet extension 54). "Cling Wrap or Material" when used herein means any material which is capable of connecting to itself upon contacting engagement during the wrapping process and is wrappable about an item whereby portions of the cling material contactingly engage and connect to other portions of another material, or, alternatively, itself, for generally partially forming a portion of a vase.

The cling material is constructed and treated if necessary, from polyethylene such as Cling Wrap made by Glad®, First Brands Corporation, Danbury, Connecticut. The cling material will range in thickness from less than about 0.1 mils to about 10 mils, and preferably less than about 0.5 mils to about 2.5 mils and most preferably from less than about 0.6 mils to about 2 mils. However, any thickness of cling material may be utilized in accordance with the present invention which permits the cling material to function as described herein.

The floral holding medium (such as foam) 40 disposed within the lower inner space 38 functions to hold a portion of the floral grouping 42, for providing moisture or nutrients, or for providing additional weight to the vase described herein to counterbalance the floral grouping 42. The floral holding medium 40 may further comprise a growing medium for extending the life of the floral grouping 42 disposed within the inner space 38 of the vase 10. Such floral holding materials 40 are well known to those of ordinary skill in the art.

As noted above, the floral grouping 42 generally comprises a bloom portion 44 and a stem portion 46. Further, the floral grouping 42 may comprise a root portion (not shown) as well. However, it will be appreciated that the floral grouping 42 may consist of only a single bloom or only foliage, or a botanical item (not shown), or a propagule (not shown). The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores. The floral holding material 40 is added to the container after the container has been constructed.

Although the bonding material 30 is shown in FIGS. 3 and 4 as comprising a continuous disc, the bonding material may instead be disposed upon the bottom surface 26 of the container 10 in any other geometric form or pattern including stripes, spots, or designs. One method for disposing a bonding material on the sheet of material, in this case an adhesive or cohesive, is described in U.S. Pat. No. 5,111,637, entitled "Method For Wrapping A Floral Grouping", issued to Weder et al., on May 12, 1992 and which is hereby incorporated herein by reference.

The term "bonding material or bonding means" when used herein means an adhesive, frequently a pressure sensitive adhesive, or a cohesive or other bonding materials which function in accordance with the present invention. When the bonding material is a cohesive, a similar cohesive material must be present on the surface which the vase will be disposed on to be bondingly contacted and bondingly connected with the cohesive material.

Changes may be made in the construction and the operation of the various components, elements and assemblies described herein or in the steps or the sequence of steps of the methods described herein without departing from the spirit and scope of the invention as defined in the following claims.

What is claimed is:

1. A container constructed from a flexible material for holding a floral grouping, the container comprising:

an upper end having an opening and a lower end having a closed base, the closed base having an outer surface and an inner surface;

a tubular body having an outer peripheral surface extending from the upper end to the outer surface of the closed base and an inner peripheral surface which encompasses and defines an interior space which extends from the opening to the inner surface of the closed base; and a bonding material disposed upon a portion of the outer surface of the closed base for bondingly connecting to a surface;

and wherein the container is collapsible to a substantially flat position and expandable therefrom to an expanded form for receiving a portion of a floral grouping in the interior space and for supporting the floral grouping in a vertical position when the bonding material is bondingly connected to a surface.

2. The container of claim 1 wherein the container is further defined as having the appearance of a vase when in expanded form.

3. The container of claim 1 further comprising a gusset in the closed base for enhancing flatness of the container when in a collapsed position.

4. The container of claim 1 further comprising an area of bonding material on the outer peripheral surface of the body for enabling attachment of a label, card, note, or other information delivery means.

5. The container of claim 1 wherein the container is substantially flat.

6. The container of claim 1 wherein the flexible material has a thickness in a range of from about 0.1 mils to about 30 mils.

7. The container of claim 1 wherein the flexible material has a thickness in a range of from about 0.2 mils to about 10 mils.

8. The container of claim 1 wherein the flexible of material has a thickness in a range of from about 0.5 mils to about 5 mils.

9. The container of claim 1 further comprising a label disposed on a portion of the outer peripheral surface.

10. The container of claim 1 further comprising a release strip for covering the bonding material prior to use of the bonding material to engage a surface.

11. The container of claim 1 wherein the flexible material is further defined as selected from the group consisting of a paper (untreated or treated in any manner), cellophane, foil, polymer film, fabrics (woven or nonwoven, synthetic or natural), burlap, or combinations thereof.

12. The container of claim 1 further defined as a bud vase for containing one bud or flower.

13. The container of claim 1 wherein the bonding material is further defined as an adhesive or cohesive.

14. A container constructed from a flexible material for holding a floral grouping, comprising:

an upper end having an opening and a lower end having a closed base, the closed base having an outer surface and an inner surface;

a tubular body having an outer peripheral surface extending from the upper end to the outer surface of the closed base and an inner peripheral surface which encompasses and defines an interior space which extends from the opening to the inner surface of the closed base;

a sheet extension which extends a distance beyond the upper end of the tubular body for providing a protective wrap about a portion of a floral grouping; and a bonding material disposed upon a portion of the outer surface of the closed base for bondingly connecting to a surface;

and wherein the container is collapsible to a substantially flat position and expandable therefrom to an expanded form for receiving a portion of a floral grouping in the interior space and for supporting the floral grouping in a vertical position when the bonding material is bondingly connected to a surface.

15. The container of claim 14 wherein the sheet extension comprises a flexible material having a lesser thickness than the flexible material used to form the body of the container.

16. The container of claim 14 further comprising detaching means for detaching the sheet extension from the body of the container.

17. The container of claim 14 further comprising a bonding material disposed on a portion of the sheet extension for sealing the sheet extension.

18. The container of claim 14 wherein the container is further defined as having the appearance of a vase when in expanded form.

19. The container of claim 14 further comprising a gusset in the closed base for enhancing flatness of the container when in a collapsed position.

20. The container of claim 14 further comprising an area of bonding material on the outer peripheral surface of the body for enabling attachment of a label, card, note, or other information delivery means.

21. The container of claim 14 wherein the container is substantially flat.

22. The container of claim 14 wherein the flexible material has a thickness in a range of from about 0.1 mils to about 30 mils.

23. The container of claim 14 wherein the flexible material has a thickness in a range of from about 0.2 mils to about 10 mils.

24. The container of claim 14 wherein the flexible material has a thickness in a range of from about 0.5 mils to about 5 mils.

25. The container of claim 14 further comprising a label disposed on a portion of the outer peripheral surface.

26. The container of claim 14 further comprising a release strip for covering the bonding material prior to use of the bonding material to engage a surface.

27. The container of claim 14 wherein the flexible material is further defined as selected from the group consisting of a paper (untreated or treated in any manner), cellophane, foil, polymer film, fabrics (woven or nonwoven, synthetic or natural), burlap, or combinations thereof.

28. The container of claim 14 further defined as a bud vase for containing one bud or flower.

29. The container of claim 14 wherein the bonding material is further defined as an adhesive or cohesive.

30. A plant package, comprising:

a container constructed from a flexible material, the container comprising:

an upper end having an opening and a lower end having a closed base, the closed base having an outer surface and an inner surface, a tubular body having an outer peripheral surface extending from the upper end to the outer surface of the closed base and an inner peripheral surface which encompasses and defines an interior space which extends from the opening to the inner surface of the closed base, and a bonding material disposed upon a portion of the outer surface of the closed base for bondingly connecting to a surface and wherein the container is collapsible to a substantially flat position and expandable therefrom to an expanded form for receiving a portion of a floral grouping in the interior space and for supporting the floral grouping in a vertical position when the bonding material is bondingly connected to a surface; and a floral grouping having a lower portion thereof disposed within the interior space and an upper portion thereof extending above the opening of the upper end of the container.

31. The plant package of claim 30 wherein the container is further defined as having the appearance of a vase when in expanded form.

32. The plant package of claim 30 wherein the closed base further comprises a gusset for enhancing flatness of the container when in a collapsed position.

33. The plant package of claim 30 further comprising an area of bonding material on the outer peripheral surface of the body for enabling attachment of a label, card, note, or other information delivery means.

34. The plant package of claim 30 wherein the container is substantially flat.

35. The plant package of claim 30 wherein the flexible material used to form the container has a thickness in a range of from about 0.1 mils to about 30 mils.

36. The plant package of claim 30 wherein the flexible material used to form the container has a thickness in a range of from about 0.2 mils to about 10 mils.

37. The plant package of claim 30 wherein the flexible material used to form the container has a thickness in a range of from about 0.5 mils to about 5 mils.

38. The plant package of claim 30 wherein the container further comprises a label disposed on a portion of the outer peripheral surface.

39. The plant package of claim 30 wherein the container further comprises a release strip for covering the bonding material prior to use of the bonding material to engage a surface.

40. The plant package of claim 30 wherein the flexible material is further defined as selected from the group consisting of a paper (untreated or treated in any manner), cellophane, foil, polymer film, fabrics (woven or nonwoven, synthetic or natural), burlap, or combinations thereof.

41. The plant package of claim 30 wherein the container is further defined as a bud vase for containing one bud or flower.

42. The plant package of claim 30 wherein the bonding material is further defined as an adhesive or cohesive.

43. The plant package of claim 30 wherein a floral holding material is disposed within the interior space of the container for supporting a floral grouping in the container.

44. The plant package of claim 30 wherein the container further comprises a sheet extension which extends a distance beyond the upper end of the tubular body for providing a protective wrap about the floral grouping.

45. The plant package of claim 44 wherein the sheet extension further comprises a bonding material disposed thereon for sealing the sheet extension.

* * * * *